US007327950B2

(12) United States Patent
Cohen

(10) Patent No.: US 7,327,950 B2
(45) Date of Patent: Feb. 5, 2008

(54) SEMI-INSTANTANEOUS WATER HEATER SYSTEM

(75) Inventor: Kenneth Cohen, Fort Lee, NJ (US)

(73) Assignee: Westcast, Inc., Westfield, MA (US)

( * ) Notice: Subject to any disclaimer, the term of this patent is extended or adjusted under 35 U.S.C. 154(b) by 0 days.

(21) Appl. No.: 11/319,671

(22) Filed: Dec. 28, 2005

(65) Prior Publication Data

US 2006/0153550 A1 Jul. 13, 2006

Related U.S. Application Data

(60) Provisional application No. 60/640,752, filed on Dec. 30, 2004.

(51) Int. Cl.
*F24H 1/34* (2006.01)

(52) U.S. Cl. ..... 392/461; 392/465; 126/15.1

(58) Field of Classification Search ..... None
See application file for complete search history.

(56) References Cited

U.S. PATENT DOCUMENTS 1,611,764 A * 12/1926 Mendelson ..... 165/76
4,637,347 A * 1/1987 Troy ..... 122/15.1
5,596,952 A * 1/1997 Lannes et al. ..... 122/14.1
5,701,387 A * 12/1997 McGugan ..... 392/456
2004/0103854 A1* 6/2004 Cui et al. ..... 122/18.1

* cited by examiner

*Primary Examiner*—Thor S. Campbell
(74) *Attorney, Agent, or Firm*—McCormick, Paulding & Huber LLP

(57) ABSTRACT

A water heater system includes a boiler having a supply port, an output port and a recirculation input port. A heat exchanger includes first input and output ports, and second input and output ports. An averaging tank has an inlet and an outlet. A first fluid flow subsystem is for controllably directing water along a primary loop through the boiler and from the output port of the boiler to the input recirculation port via either a first path through the first ports of the heat exchanger or a second path bypassing the heat exchanger. A second fluid flow subsystem is for directing water along a secondary loop through the second ports of the heat exchanger, through the inlet and outlet of the averaging tank, and back to the heat exchanger, whereby water directed through the secondary loop is heated from water directed through the primary loop via the heat exchanger.

16 Claims, 3 Drawing Sheets

SEMI-INSTANTANEOUS WATER HEATER SYSTEM

CROSS-REFERENCE TO RELATED APPLICATION

This application claims the benefit of U.S. Provisional Application No. 60/640,752, filed on Dec. 30, 2004, the disclosure of which is herein incorporated by reference in its entirety.

TECHNICAL FIELD

The present invention relates to water heater systems, and more particularly relates to a semi-instantaneous water heater system that can maintain water temperature within a prescribed error band at any rate of flow whether varying or continuous between zero flow and the maximum capability of the energy source.

BACKGROUND

The commercial water heater industry has been served by storage tank water heaters that are sized to contain sufficient water at a specified temperature to satisfy demand during the highest expected usage. While this method has proven satisfactory for most applications, it requires large storage volumes, with associated losses, large footprint, and excessive set point temperatures to ensure performance. The commercial water heaters are typically operated in various ways.

One way is to select a maximum and minimum temperature set point relatively far apart from one another in order to minimize the frequency of power cycling of the water heater. For example, the maximum temperature set point might be twenty degrees higher than the desired water temperature. The water heater is cycled on until the actual water temperature reaches the maximum temperature set point. When the actual temperature of water in the heater drops to the minimum temperature set point at around the desired temperature, power to the water heater is cycled on again until the actual temperature reaches the maximum temperature set point. A drawback with this approach is that an inordinate amount of energy is required for heating the water in the water heater to a temperature well in excess of the desired temperature. Moreover, the excessive temperature can lead to scalding should water be drawn toward the end of an operating cycle. Further, employing a large water heater can typically leads to temperature striations along various levels of the water heater leading to high fluctuations in water temperature should a high load demand be suddenly imposed on the water heater.

A second way to operate a large water heater is to select a maximum and minimum temperature set point relatively close to one another in order to minimize energy consumption. For example, the maximum temperature set point might be only a few degrees higher than the desired water temperature. The water heater is cycled on until the actual water temperature reaches the maximum temperature set point. When the actual temperature of water in the heater drops to the minimum temperature set point at around the desired temperature, power to the water heater is cycled on again until the actual temperature reaches the maximum temperature set point. A drawback with this approach is that the close proximity between the maximum and minimum temperature set points results in frequent on and off power cycling which can shorten the operating life of the equipment for cycling power to the water heater.

Instantaneous heaters have also been applied with limited success. Their inability to respond to instantaneous flow changes and high cycling rates of the water heater due to recirculation loads has limited use by this method.

Accordingly, it is a general object of the present invention to overcome the drawbacks associated with prior water heater systems.

SUMMARY OF THE INVENTION

The present invention resides in a water heater system comprising a boiler including a supply port, an output port and a recirculation input port. A heat exchanger has a first input port, a first output port, a second input port and a second output port. An averaging tank has an inlet and an outlet. A first fluid flow subsystem is for controllably directing water along a primary loop through the boiler and from the output port of the boiler to the input recirculation port via either a first path through the first ports of the heat exchanger or a second path bypassing the heat exchanger. A second fluid flow subsystem is for directing water along a secondary loop through the second ports of the heat exchanger, through the inlet and outlet of the averaging tank, and back to the heat exchanger, whereby water directed through the secondary loop is heated from water directed through the primary loop via the heat exchanger.

DETAILED DESCRIPTION OF THE PREFERRED EMBODIMENTS

Figure 1:
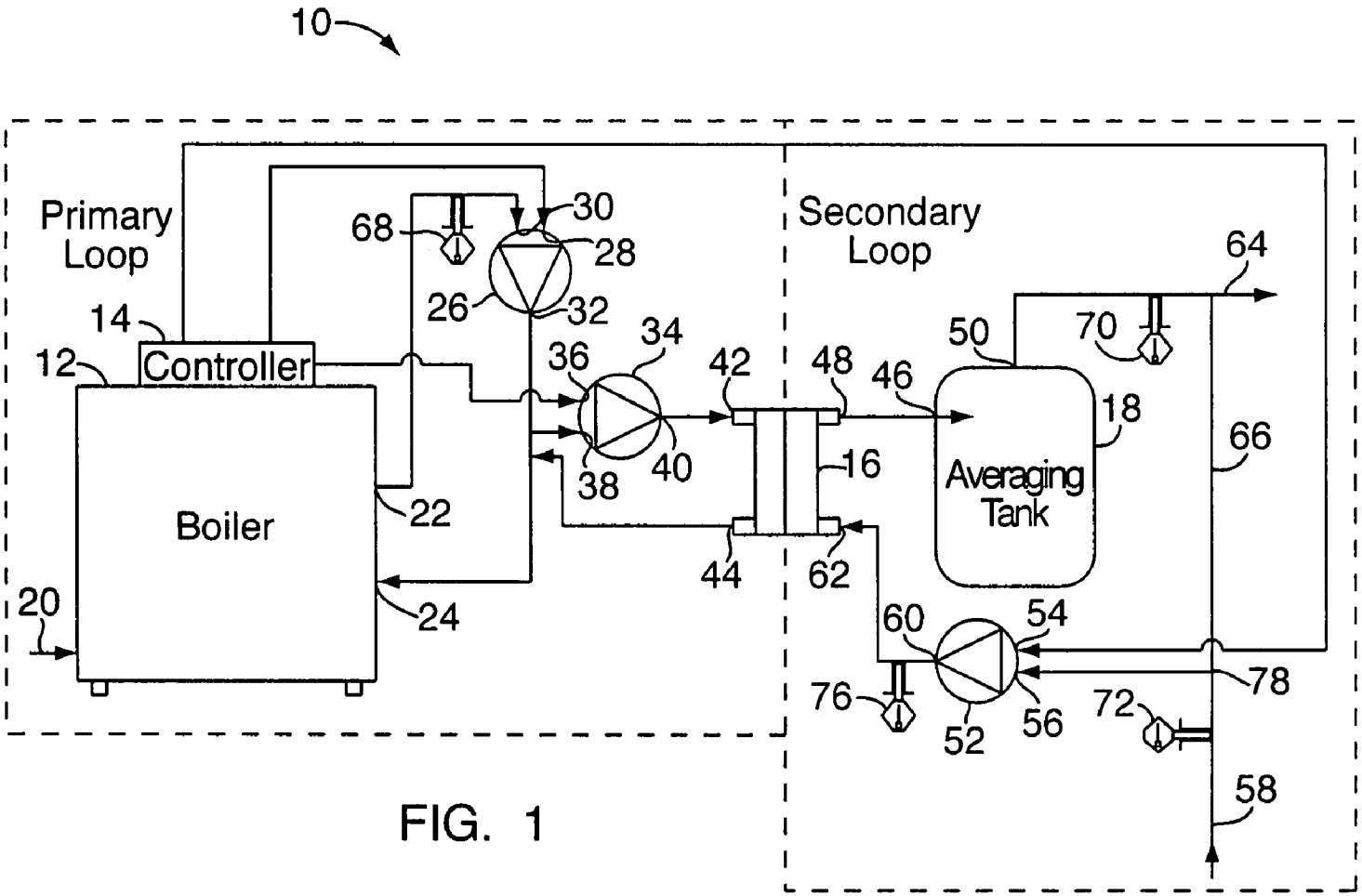
FIG. 1 is a schematic diagram of a water heater system embodying the present invention.

A water heater system embodying the present invention is indicated generally by the reference number 10. The system 10 comprises a boiler 12, a controller 14, a heat exchanger 16, and an averaging tank 18. The controller 14 is shown as being separate from the boiler 12, but it should be understood that the controller can be part of the boiler circuitry without departing from the scope of the present invention.

The boiler 12 includes an input port 20, an output port 22 and a recirculation input port 24. A first pump 26 has a control terminal 28 for receiving a control signal from the controller 14, an input 30 coupled to the output port 22 of the boiler 12, and an output 32 coupled to the recirculation input port 24 of the boiler. A second pump 34 has a control terminal 36 for receiving a control signal from the controller 14, an input 38 coupled to the output 32 of the first pump 26, and an output 40 coupled to a first input port 42 of the heat exchanger 16.

As mentioned above, the heat exchanger 16 includes a first input port 42 coupled to the output 40 of the second pump 34. A first output port 44 of the heat exchanger 16 is coupled to the recirculation input port 24 of the boiler 12. When the first pump 26 is on and the second pump 34 is on, water flows around a primary loop through the boiler 12, through the first pump 26, through the second pump 34, through the first input and output ports 42, 44 of the heat exchanger 16 and back to the boiler. When the first pump 26 is on and the second pump 34 is off, water leaving the output port 22 of the boiler 12 flows through the first pump 26 and returns to the recirculation input port 24 of the boiler so as to bypass the heat exchanger 16 for the reason to be explained more fully below.

The averaging tank 18 includes an inlet 46 coupled to a second output port 48 of the heat exchanger 16, and an outlet 50 for allowing water to be channeled either back to the averaging tank 18 and to remote locations for end use. A third pump 52 for moving water to the averaging tank 18 has a control terminal 54 for receiving a control signal from the controller 14, an input 56 coupled to a supply line 58 and to the outlet 50 of the averaging tank, and an output 60 coupled to a second input port 62 of the heat exchanger 16. When the third pump 52 is on, water flows from the supply line 58, through the heat exchanger 16 via the second input and output ports 62, 48, and through the averaging tank 18 via the inlet 46 and the outlet 50 thereof. Water exiting the averaging tank 18 can then flow via exit line 64 to remote locations for end use. A portion of the water leaving the averaging tank 18 is recirculated by flowing through a return line 66 to the input 56 of the third pump 52.

The system 10 further includes a plurality of sensors communicating with the controller 14 for transmitting to the controller signals indicative of the water temperature at various locations in the system. As shown in FIG. 1, a first sensor 68 is located along the primary loop between the output port 22 of the boiler 12 and the input 30 of the first pump 26 to detect the water temperature of the boiler 12 (Tblr) adjacent to the output port of the boiler. A second sensor 70 is located along the secondary loop adjacent to the outlet 50 of the averaging tank 18 so as to detect the set point water temperature (Tsp) of the averaging tank. A third sensor 72 is located along the supply line 58 to the secondary loop so as to detect water supply temperature (Tc) to the secondary loop. A fourth sensor 76 is located along the secondary loop downstream in the direction of water flow of a junction 78 of the supply line 58 and the secondary loop and upstream of the heat exchanger 16 so as to detect water temperature (Tmix) of a mixture of supply water and water leaving the averaging tank 18.

A water heater system in accordance with a second embodiment of the present invention is indicated generally by the reference number 110. Like elements with the system 10 are indicated by like reference numbers preceded by "1". The system 110 comprises a boiler 112, a controller 114, a heat exchanger 116, and an averaging tank 118. The controller 114 is shown as being separate from the boiler 112, but it should be understood that the controller can be part of the boiler circuitry without departing from the scope of the present invention.

The boiler 112 includes an input port 120, an output port 122 and a recirculation input port 124. A first pump 126 has a control terminal 128 for receiving a control signal from the controller 114, an input 130 coupled to the output port 122 of the boiler 112, and an output 132 coupled to an input 133 of a three-way control valve 135. The three-way valve 135 further has a control terminal 137 for receiving a control signal from the controller 114, a first output 139 coupled to a first input port 142 of the heat exchanger 116, and a second output 141 coupled to the recirculation input port 124 of the boiler 112.

As mentioned above, the heat exchanger 116 includes a first input port 142 coupled to the first output 139 of the three-way valve 135. A first output port 144 of the heat exchanger 116 is coupled to the recirculation input port 124 of the boiler 112. When the first pump 126 is on, the first output 139 of the three-way valve 135 is open, and the second output 141 of the three-way valve is closed, water flows around a primary loop through the boiler 112, through the first pump 126, directed by the three-way valve through the first input and output ports 142, 144 of the heat exchanger 116 and back to the boiler. When the first pump 126 is on, the first output 139 of the three-way valve 135 is closed, and the second output 141 of the three-way valve is open, water leaving the output port 122 of the boiler 112 flows through the first pump 126 and is directed by the three-way valve back to the recirculation input port 124 of the boiler so as to bypass the heat exchanger 116 for the reason to be explained more fully below.

The averaging tank 118 includes an inlet 146 coupled to a second output port 148 of the heat exchanger 116, and an outlet 150 for allowing water to be channeled either back to the averaging tank 118 or to remote locations for end use. A second pump 152 for moving water to the averaging tank 118 has a control terminal 154 for receiving a control signal from the controller 114, an input 156 coupled to a supply line 158 and to the outlet 150 of the averaging tank, and an output 160 coupled to a second input port 162 of the heat exchanger 116. When the second pump 152 is on, water flows from the supply line 158, through the heat exchanger 116 via the second input and output ports 162, 148, and through the averaging tank 118 via the inlet 146 and the outlet 150 thereof. Water exiting the averaging tank 118 can then flow via exit line 164 to remote locations for end use. A portion of the water leaving the averaging tank 118 is recirculated by flowing through a return line 166 to the input 156 of the second pump 152.

Figure 2:
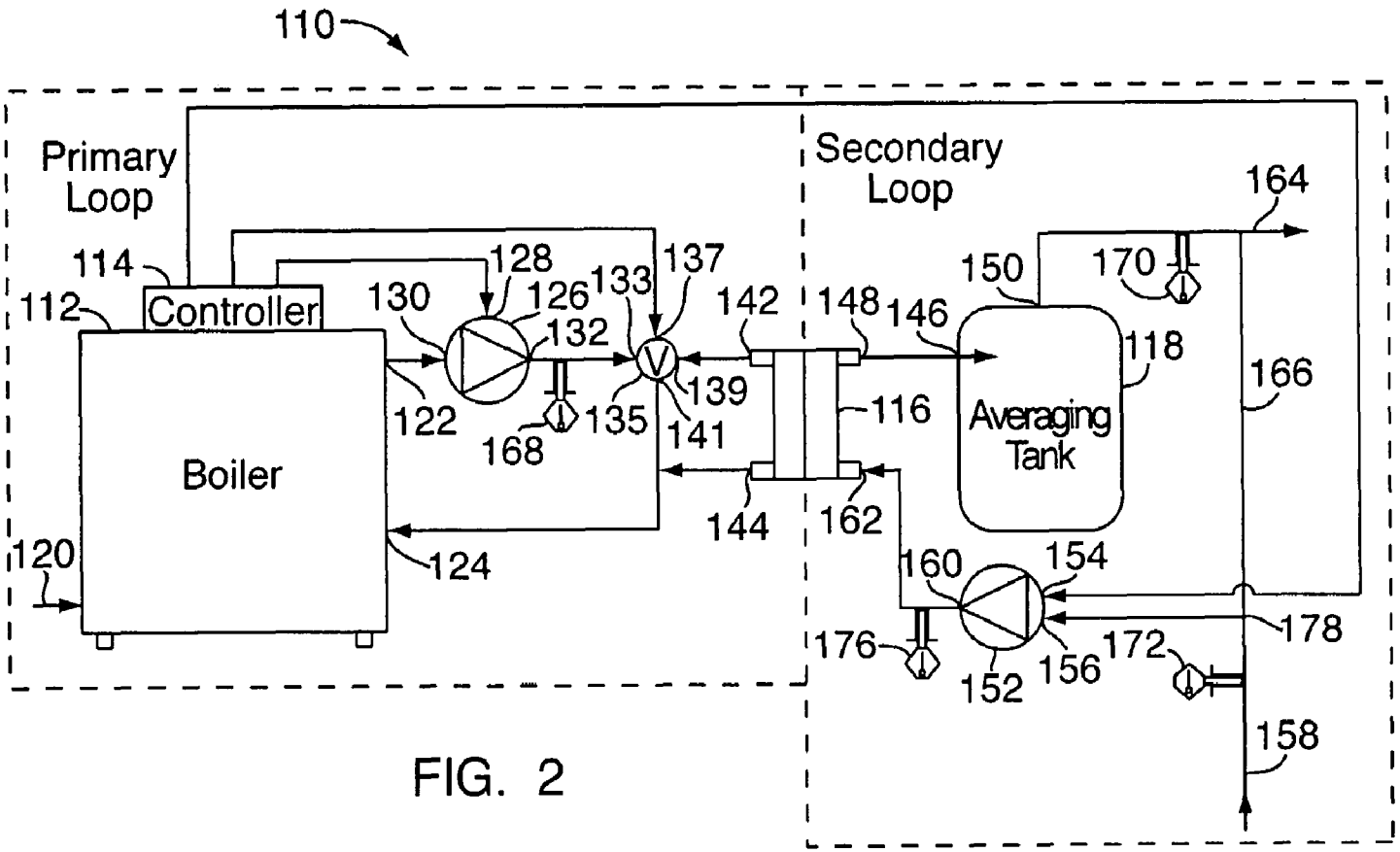
FIG. 2 is a schematic diagram of a water heater system in accordance with a second embodiment of the present invention.

The system 110 further includes a plurality of sensors communicating with the controller 114 for transmitting to the controller signals indicative of the water temperature at various locations in the system. As shown in FIG. 2, a first sensor 168 is located along the primary loop between the output port 122 of the boiler 112 and the input 133 of the three-way valve 135 to detect the water temperature of the boiler 112 (Tblr) adjacent to the output port of the boiler. A second sensor 170 is located along the secondary loop adjacent to the outlet 150 of the averaging tank 118 so as to detect the set point water temperature (Tsp) of the averaging tank. A third sensor 172 is located along the supply line 158 to the secondary loop so as to detect water supply temperature (Tc) to the secondary loop. A fourth sensor 176 is located along the secondary loop downstream in the direction of water flow of a junction 178 of the supply line 158 and the secondary loop and upstream of the heat exchanger 116 so as to detect water temperature (Tmix) of a mixture of supply water and water leaving the averaging tank 118.

The present invention embodied in the systems of FIGS. 1 and 2 uses the energy stored in an iron boiler to reduce boiler cycling, the low heat capacity of a plate heat exchanger combined with an averaging tank to maintain temperature accuracy during load changes.

The Advantageous of this Type of System Are:

1. Accurate temperature delivery over the entire flow range allowing the reduction of set point temperature with the associated reduction in scalding potential and recirculation losses.
2. Small footprint
3. Low cycling rates with a modulating iron boiler of moderate turndown (4:1). (The turndown is the continuous change in BTU/hr of which the boiler is capable.)

4. A low time constant (the speed with which the system can be readjusted to a new set point) allows variation of set point to meet changing water temperature requirements throughout the day.

The averaging tank acts as a "flywheel" to store sufficient energy to maintain temperature during the boiler start delay and rapid changes in load.

The second pump 34 (see FIG. 1) or the three-way control valve 135 (see FIG. 2) in the primary loop moves or directs boiler energy to the secondary loop via the heat exchanger or bypasses the heat exchanger back to the recirculation input port of the boiler.

The controller derives the necessary information for the specified performance from the four temperature sensors shown in the embodiments of FIGS. 1 and 2. A set point (the operating temperature of the water heater system) and a bandwidth (BW—the total temperature error allowed. IE, To max to To min)) are entered in the controller. A maximum boiler temperature (Tblr max) is also entered into the controller.

With respect to the system 10 shown in FIG. 1, the first pump 26 and the third pump 52 operate continuously. The first pump 26 maintains flow through the boiler 12 while the third pump 52 continuously mixes the water in the averaging tank 18. The second pump 34 is turned on by the controller 14 at the minimum water temperature (Tsp−BW/2) to transfer the energy in the primary loop into the water. The second pump 34 is turned off by the controller 14 at the maximum water temperature (Tsp+BW/2) to stop additional energy transfer to the water. The fast response of the second pump 34 and the low heat capacity (WCp) of the plate heat exchanger 16 ensure a rapid system response to the cycling of the second pump 34.

The boiler is started by the controller when either of two conditions is met as will be now explained with respect to the following equations.

$$DT\text{available}=(Tblr-T\text{min})\times WCp(blr)/WCp(\text{tank}) \qquad \text{Equation 1}$$

Where: DT available is the amount of temperature that the averaging tank can be increased from the energy stored in the primary source (in this case, the KN boiler).

$$FF\%=(T\text{setpoint}-T\text{mix})/T\text{ref} \qquad \text{Equation 2}$$

Where: Tref=qmax/(500.4×Qmix(pump in secondary loop)

FF % is the percent of load created by the amount of water drawn from the system. The maximum (100%) load is when the boiler must run at its full output to meet the demand. This signal tells the boiler what energy is needed to meet the instantaneous demand.

Terms:

Tblr—the temperature of the boiler water

Tmin—the minimum allowed temperature of the potable water

WCp(blr)—the energy storage capacity of the primary loop (the boiler)

WCp(tank)—the energy storage capacity of the averaging tank

Tsetpoint—the desired potable water temperature

Tmix—the temperature of the water resulting from the mixture of cold water and averaging tank water being drawn into the system by pump in the secondary loop Tref—the maximum temperature difference that could exist at 100% demand qmax—the maximum net energy available to the system from the boiler The boiler input energy required (FF) is calculated from Eq. [2]. This is the energy at which the boiler operates when it is running. If the value of (FF) is greater than the minimum input capable by the boiler, the controller immediately starts the boiler. If the value of (FF) is less than the minimum boiler input, then: when the second pump 34 (see FIG. 1) turns on or the control valve 126 is activated to direct water to the heat exchanger (see FIG. 2), the controller determines if there is enough stored energy in the primary loop to raise the temperature of the averaging tank equal to or greater than the bandwidth. If there is, a boiler start is suppressed. If not, the boiler is started by the controller and operates at its minimum input. Once started, the boiler operates until it reaches Tblr max.

Figure 3:
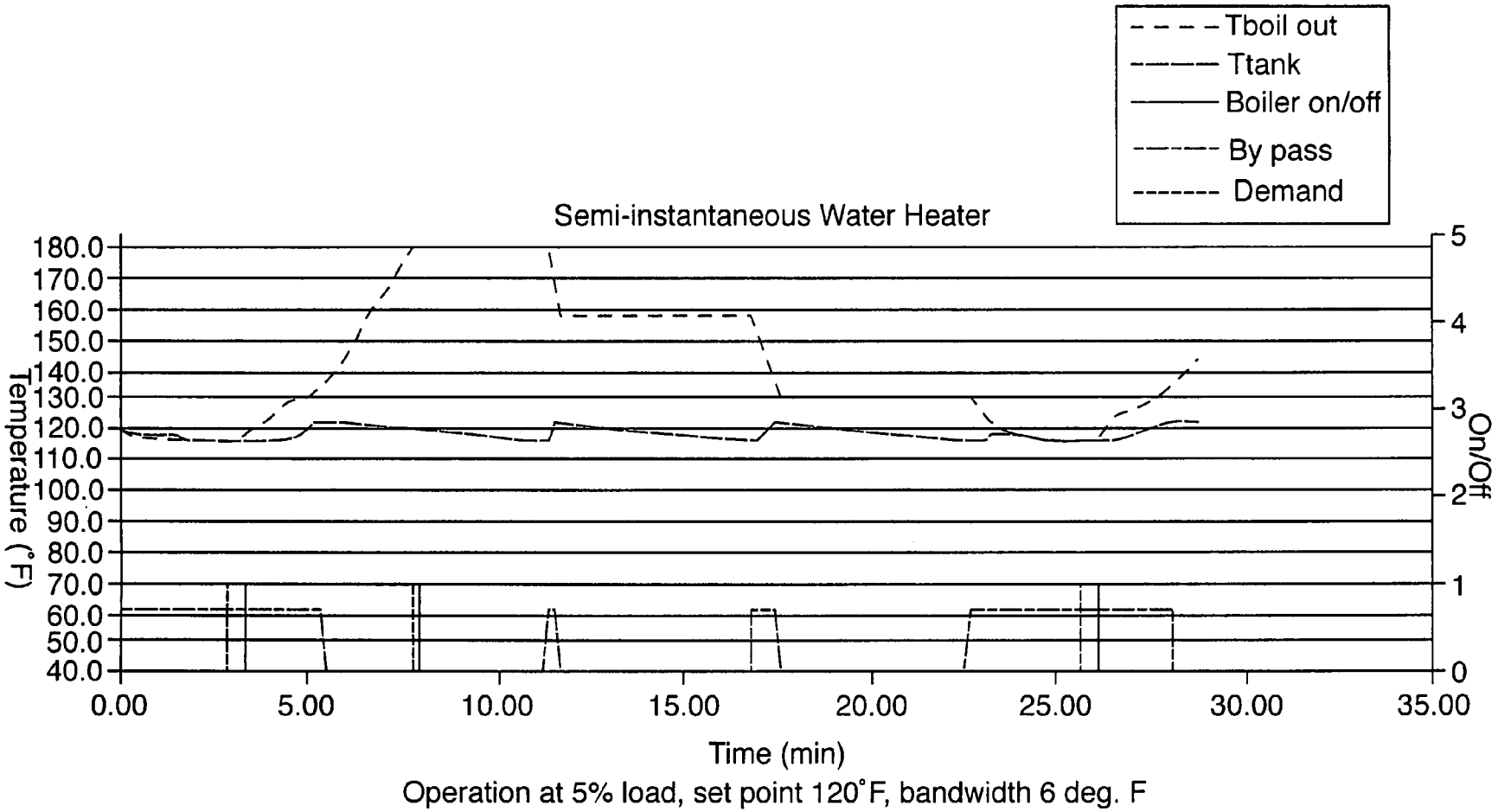
FIG. 3 are graphs illustrating various operating parameters of the water heater system in accordance with the present invention.

FIG. 3 illustrates by way of example graphs of various operating parameters of a water heater system in accordance with the present invention. The system being illustrated is operating at about 5% load, has a set point of about 120° F., and has a bandwidth of 6° F.

A graph 310 illustrates the water temperature at the output of the boiler (Tboil out) over time. A graph 312 illustrates the water temperature of the averaging tank over time. A graph 314 is indicative of when the boiler is turned on and turned off over time. A graph 316 is indicative of when water flow in the primary loop bypasses the heat exchanger over time. A graph 318 is indicative of water supply demand over time. As can be seen by the graph 312, a water heater system in accordance with the present invention maintains the temperature of the averaging tank at a generally constant temperature of about 120° F. during the cycling of the boiler and over varying water supply demand conditions.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A water heater system comprising:

a boiler including a supply port, an output port and a recirculation input port;

a heat exchanger having a first input port, a first output port, a second input port and a second output port;

an averaging tank having an inlet and an outlet;

a first fluid flow subsystem for controllably directing water along a primary loop through the boiler and from the output port of the boiler to the input recirculation port via one of a first path through the first ports of the heat exchanger and a second path bypassing the heat exchanger; and a second fluid flow subsystem for directing water along a secondary loop through the second ports of the heat exchanger, through the inlet and outlet of the averaging tank, and back to the heat exchanger, whereby water directed through the secondary loop is heated from water directed through the primary loop via the heat exchanger.

2. A water heater system as defined in claim 1, further comprising a controller communicating with the first fluid flow subsystem and the second fluid flow subsystem for controllably directing water flow through the subsystems.

3. A water heater system as defined in claim 2, further comprising at least one temperature sensor communicating with the controller for providing the controller with signals indicative of the temperature of water flowing at various locations.

4. A water heater system as defined in claim 3, wherein a sensor is located along the primary loop so as to detect water temperature adjacent to the output port of the boiler.

5. A water heater system as defined in claim 3, wherein a sensor is located along the secondary loop so as to detect water temperature adjacent to the outlet of the averaging tank.

6. A water heater system as defined in claim 3, wherein a sensor is located along a supply line to the secondary loop so as to detect water supply temperature to the secondary loop.

7. A water heater system as defined in claim 3, wherein a sensor is located along the secondary loop downstream in the direction of water flow of a junction of a supply line and the secondary loop and upstream of the heat exchanger.

8. A water heater system as defined in claim 1, wherein the first fluid flow subsystem includes:

a first pump including an input coupled to the output port of the boiler, and an output coupled to the recirculation input port of the boiler; and a second pump including an input coupled to the output of the first pump, and an output coupled to the first input port of the heat exchanger, and wherein the first output port of the heat exchanger is coupled to the recirculation input port of the boiler.

9. A water heater system as defined in claim 8, further comprising a controller communicating with the second pump, the controller being configured to turn on the second pump to direct water flow along the primary loop through the heat exchanger, and also being configured to turn off the second pump to direct water flow along the primary loop so as to bypass the heat exchanger.

10. A water heater system as defined in claim 9, wherein:

the first pump and the second pump are each variable-speed pumps; and the controller is configured for sending control signals to vary the speed of the pumps.

11. A water heater system as defined in claim 1, wherein the first fluid flow subsystem includes:

a pump having an input and an output, the input of the pump being coupled to the output port of the boiler;

a three-way valve having an input, a first output and a second output, wherein:

the input of the three-way valve is coupled to the output of the pump;

the first output of the three-way valve is coupled to the first input port of the heat exchanger; and the second output of the three-way valve is coupled to the recirculation input of the boiler, and wherein the first output of the heat exchanger is coupled to the recirculation input port of the boiler.

12. A water heater system as defined in claim 11, further comprising a controller communicating with the three-way valve, the controller being configured to open the first output of the valve and close the second output of the valve to direct water flow along the primary loop through the heat exchanger, and also being configured to close the first output of the valve and open the second output of the valve to direct water flow along the primary loop so as to bypass the heat exchanger.

13. A water heater system as defined in claim 11, wherein:

the pump is a variable-speed pump; and the controller is configured for sending control signals to vary the speed of the pump.

14. A water heater system as defined in claim 1, wherein the second fluid flow subsystem includes a pump having an input coupled to a supply line and to an outlet of the averaging tank, and having an output coupled to the second input port of the heat exchanger.

15. A water heater system as defined in claim 14, further comprising a controller communicating with the pump.

16. A water heater system as defined in claim 15, wherein:

the pump is a variable-speed pump; and the controller is configured for sending control signals to vary the speed of the pump.

* * * * *